US005613443A

United States Patent [19]

Ariga et al.

[11] Patent Number: 5,613,443

[45] Date of Patent: Mar. 25, 1997

[54] AMUSEMENT RIDE FOR TRAVELING DOWN A WATER CHUTE WITH REDUCED SPLASH

[75] Inventors: Moriaki Ariga, Yokohama; Reiichi Ojima, Hachiohji; Yoshihiro Kawauchi, Tokyo; Toshihiro Kobayashi, Fujisawa, all of Japan

[73] Assignee: The Walt Disney Company, Del.

[21] Appl. No.: 290,889

[22] PCT Filed: Jul. 14, 1993

[86] PCT No.: PCT/US93/06628

§ 371 Date: Jun. 27, 1995

§ 102(e) Date: Jun. 27, 1995

[87] PCT Pub. No.: WO94/05389

PCT Pub. Date: Mar. 17, 1994

[30] Foreign Application Priority Data

Sep. 2, 1992 [JP] Japan ..... 4-234983

[51] Int. Cl.[6] ..... A63G 21/00

[52] U.S. Cl. ..... 104/70; 104/72; 472/117; 472/129

[58] Field of Search ..... 104/53, 59, 70, 104/72, 73, 86, 69; 472/117, 13, 128, 129

[56] References Cited

U.S. PATENT DOCUMENTS

| | | | |
|---|---|---|---|
| 754,698 | 3/1904 | Reed | 104/70 |
| 1,463,137 | 7/1923 | Makepeace | 104/73 X |
| 4,392,434 | 7/1983 | Durwald et al. | 104/73 X |
| 4,516,943 | 5/1985 | Spieldiener et al. | 472/13 X |

FOREIGN PATENT DOCUMENTS

| | | | |
|---|---|---|---|
| 9969 | 6/1902 | Austria | 104/73 |
| 325125 | 4/1903 | France . | |
| 20417 | 7/1903 | United Kingdom | 104/70 |

*Primary Examiner*—Mark T. Le

*Attorney, Agent, or Firm*—Pretty, Schroeder, Brueggemann & Clark

[57] ABSTRACT

An amusement ride includes a vehicle traveling down a chute through a region of water. The vehicle is shaped to minimize splashing and to allow water to flow away from the vehicle. The vehicle flanks are curved to deflect splashing water down and away from the vehicle, and the vehicle bow has upper flanks to deflect water down and away from the vehicle. The vehicle bottom has a concave channel to accommodate water displaced by the vehicle. The vehicle has sets of wheels for traveling, for guiding lateral motion, and for interlocking with floating prevention mechanism. A groove along each side of the vehicle accommodates a splash prevention member on the water chute.

16 Claims, 7 Drawing Sheets

FIG. 1
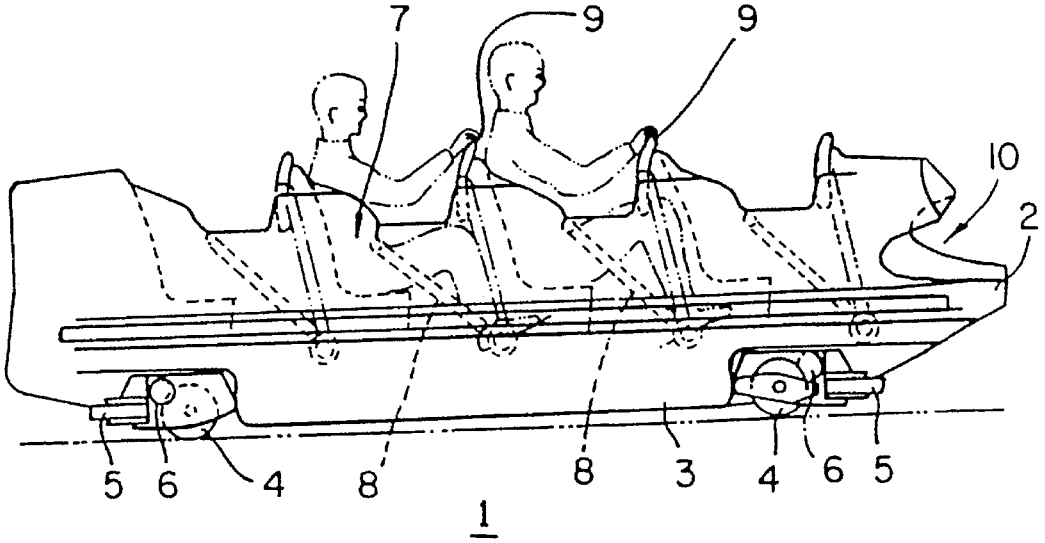
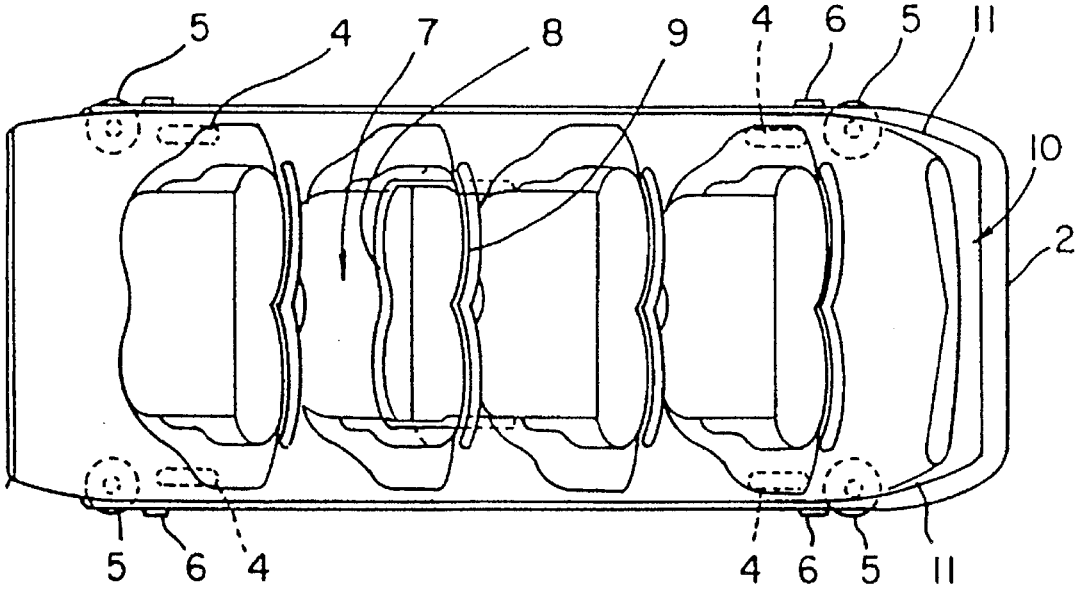
FIG. 2

FIG. 3
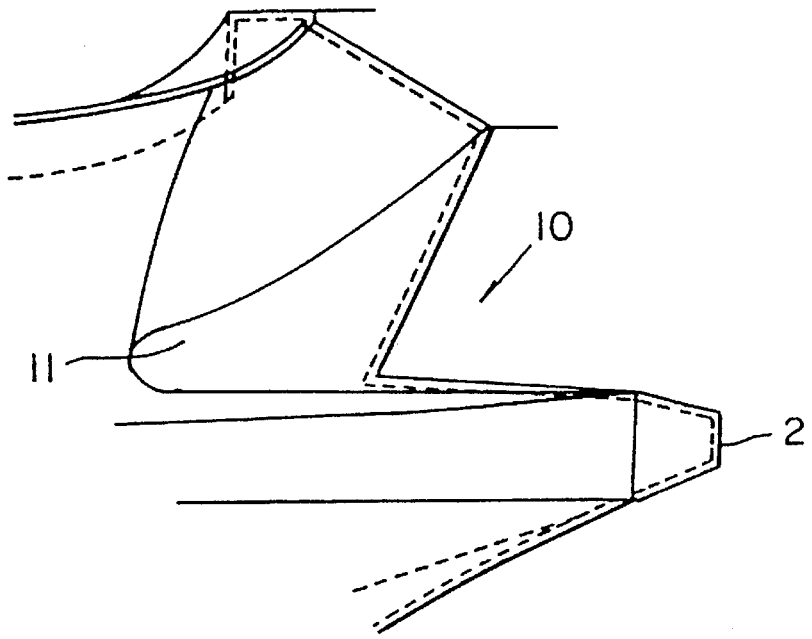
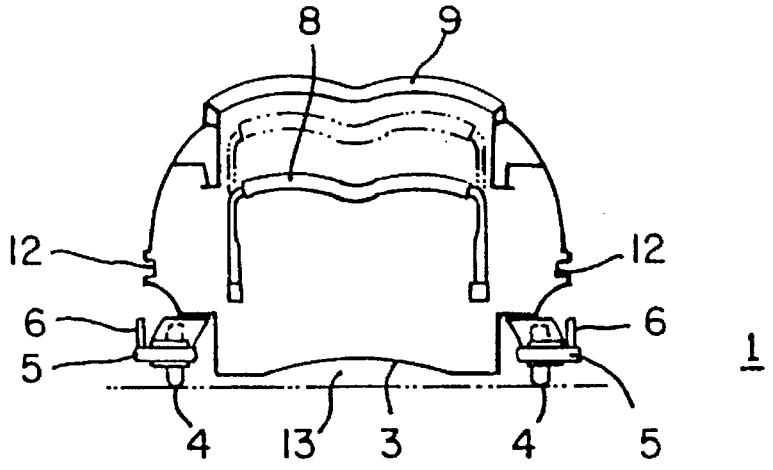
FIG. 4

FIG. 8
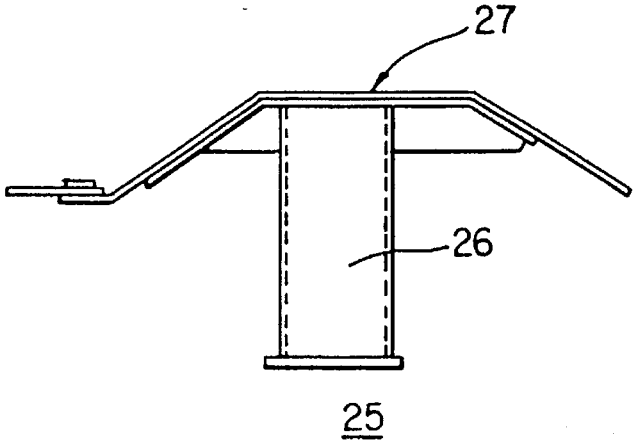
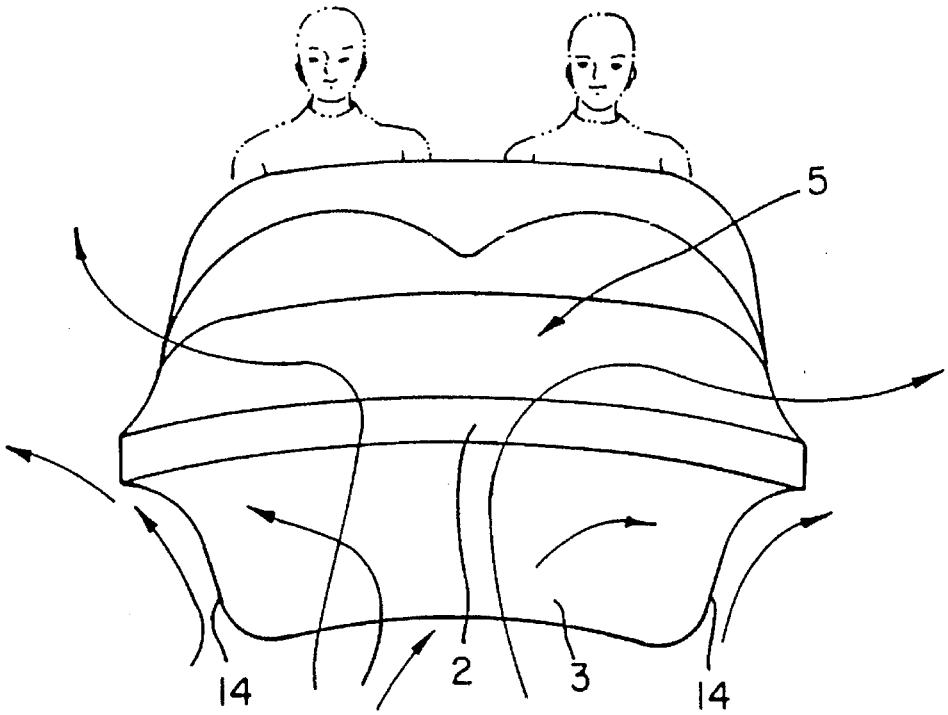
FIG. 10

AMUSEMENT RIDE FOR TRAVELING DOWN A WATER CHUTE WITH REDUCED SPLASH

BACKGROUND OF THE INVENTION

The present invention relates to an amusement vehicle, and in specific a ride amusement for traveling down a chute having a region containing water through which a ride vehicle travels.

In recent years, amusement apparatuses tend to be larger in scale and more diversified. Among them, the roller coaster has been a popular apparatus for many years, since its introduction.

Recent roller coasters are provided to travel on a track making looped or spiral turns, etc., to provide a thrilling attraction to the riders.

An attraction ride, similar to a roller coaster, is achieved with a water chute in which a boat slides down on a sharp slope to plunge into a pond.

In such a water chute, when the boat has reached the pond, a great amount of splashing occurs, resulting in water rushing onto the passengers' seats. Previous attempts to minimize the amount of water splashing onto the passengers have consisted of confining the descending height of the boat to under 10 meters, using a boat that is specially formed to repel the splashing water forward with respect to the direction of the boat, and adding PVC covers as shields against the direct splashing of water onto the passengers.

However, such attractions in which the descending height of the vehicle is reduced, provides a less thrilling attraction to the passengers. Furthermore, the use of transparent covers such as PVC covers for repelling splashes, while keeping the thrilling view visible to the passengers, nonetheless reduces the desirable amusement effect of the apparatus. Thus, the popularity of the water chute is declining.

The present invention has been made to solve this problem. The object of the present invention is to provide an amusement vehicle by specially shaping the bottom of a boat for preventing the direct splashing on passengers without impairing the attractiveness as an amusement apparatus.

SUMMARY OF THE INVENTION

To solve the above problem, the present invention provides an amusement vehicle caused to travel down on a gradient passage with a water channel, comprising an inwardly curved surface at the bottom and additional inwardly curved surfaces from the bottom upward to protrude outside in the width direction of the vehicular main body.

The vehicle can have wheels and the gradient passage can be provided, at its upper portions, with floating preventive means to prevent the floating of the vehicle while the vehicle is traveling down with its wheels in contact with the passage.

Furthermore, the vehicle can be provided, on its flanks, with guide grooves, and the gradient passage can be provided, at its upper portions, with splashing preventive means to be idly engaged with said guide grooves.

When the amusement vehicle travels down on the water channel, or when it plunges onto the water channel from the gradient passage, water passes from the bow or tip of the vehicular main body along the inwardly curved bottom toward the rear of the vehicular main body, to decrease the impact of water at the tip of the vehicular main body. Furthermore, even if water goes around the flanks of the vehicular main body, it is pushed away toward the outside laterally with respect to the direction of travel of the vehicular main body, to decrease the quantity of water sent forward, thus reducing the splashes.

The acceleration of the vehicle running down on the gradient passage and the water current on the water channel tend to cause the vehicle to be lifted, but this force is counteracted by the vehicle running with its wheels guided in contact with the floating preventive means, and thus the floating tendency can be prevented.

The water going around the flanks of the vehicular main body and pushed away toward the outside in the width direction of the vehicular main body can be prevented from splashing onto the passengers' seats from the flanks of the vehicular main body by the water splashing preventive means.

BRIEF DESCRIPTION OF THE DRAWINGS

FIG. 1 is a schematic side view showing the amusement vehicle of the present invention.

FIG. 2 is an illustrative plan view showing the amusement vehicle illustrated in FIG. 1.

FIG. 3 is an expanded side view showing the bow tip of the amusement vehicle illustrated in FIGS. 1 and 2.

FIG. 4 is an illustrative cross sectional view showing the amusement vehicle illustrated in FIGS. 1 and 2.

FIG. 8 is a sectional view showing the splashing preventive means.

FIG. 10 is an illustration showing the action of the amusement vehicle traveling on the water channel.

DETAILED DESCRIPTION OF THE PREFERRED EMBODIMENT

Figure 5:
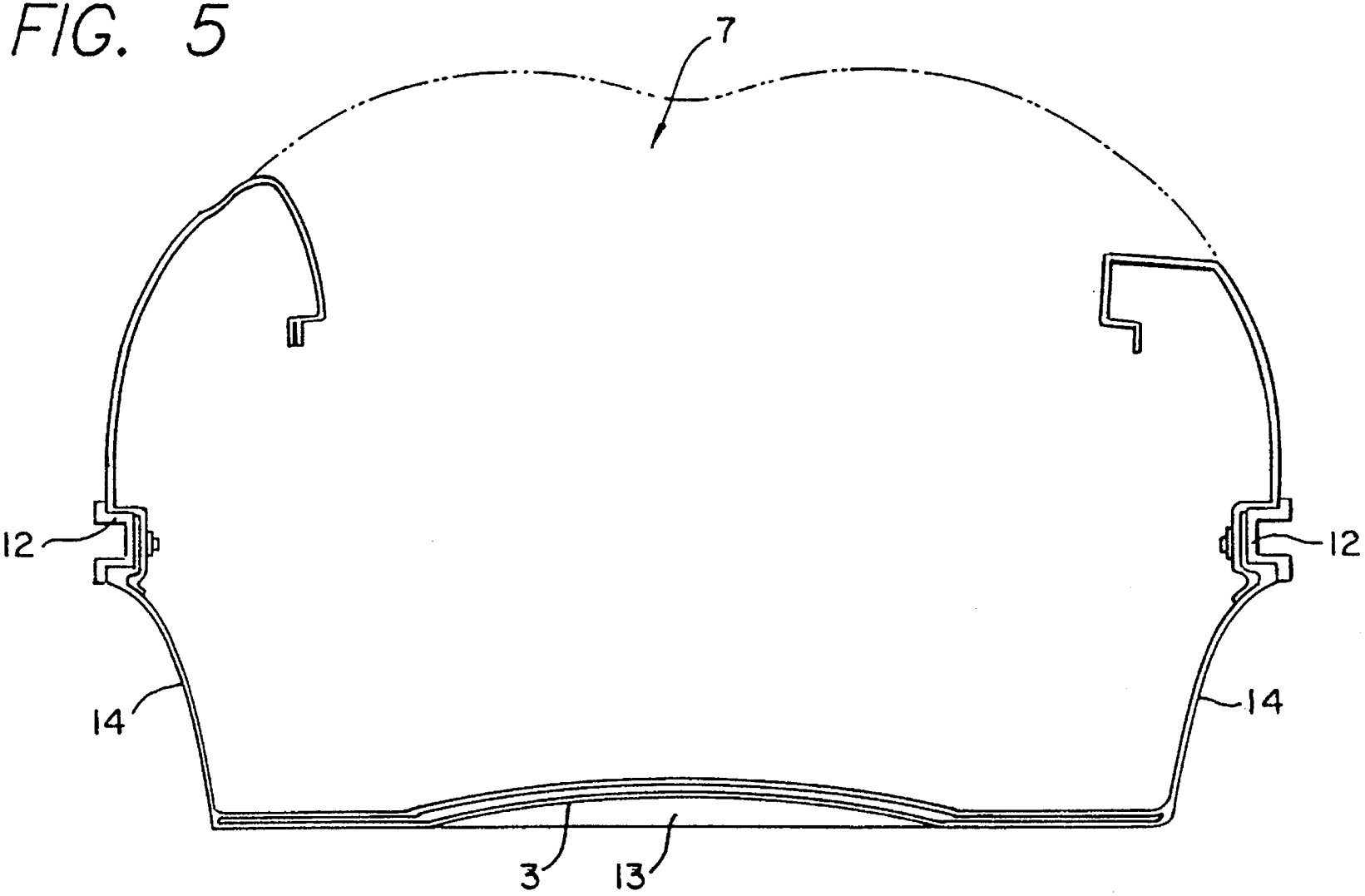
FIG. 5 is an illustration describing the cross sectional form of the amusement vehicle illustrated in FIGS. 1 and 2.

The amusement vehicle of the present invention is described below in detail, with reference to the drawings and the example herein described.

In FIG. 1, symbol 1 denotes an amusement vehicle of the present invention. The amusement vehicle 1 is formed like a boat to travel down, for example, on a gradient passage and a passage with a water channel (described later). The amusement vehicle 1 is made of a synthetic resin, and the tip 2 of the vehicular main body is shaped to rise from the bottom 3 toward the tip point.

The bottom 3 has main wheels 4 used for traveling along the passage (described later), guide wheels 5 used for guiding in contact with the side walls (described later) of the passage, and support wheels 6 for preventing the vehicular main body from floating.

This amusement vehicle 1 has four two-passenger seats 7 for eight passengers in total. The seats 7 are provided with holders 8 for holding the bodies of passengers and grips 9 to be grasped by the passengers.

At the tip 2 of the vehicular main body on the upper part, a cut-out portion 10 spreading toward the rear of the vehicular main body and outward in the width or lateral direction of the vehicular main body is formed. The cut-out portion 10 has water guide faces 11 formed symmetrically about the central axis of the vehicular main body from the center toward both the flanks (see FIG. 3).

Furthermore, in the main body of the amusement vehicle 1, guide grooves 12 are formed to be slidably engaged with the splashing preventive means (described later) provided on the side walls of the passage.

In the amusement vehicle 1 as described above, as shown in FIG. 4, the bottom 3 is inwardly curved with the longitudinal central axis of the vehicular main body as the vertex, to form a space 13 near the central axis.

The flanks 14 are also inwardly curved from the bottom 3 upward to protrude outside in the width direction of the vehicular main body. The shapes (see FIG. 5) of the vehicular main body, the bottom 3 and the flanks 14 of the amusement vehicle 1 have been optimized by traveling tests.

Figure 6:
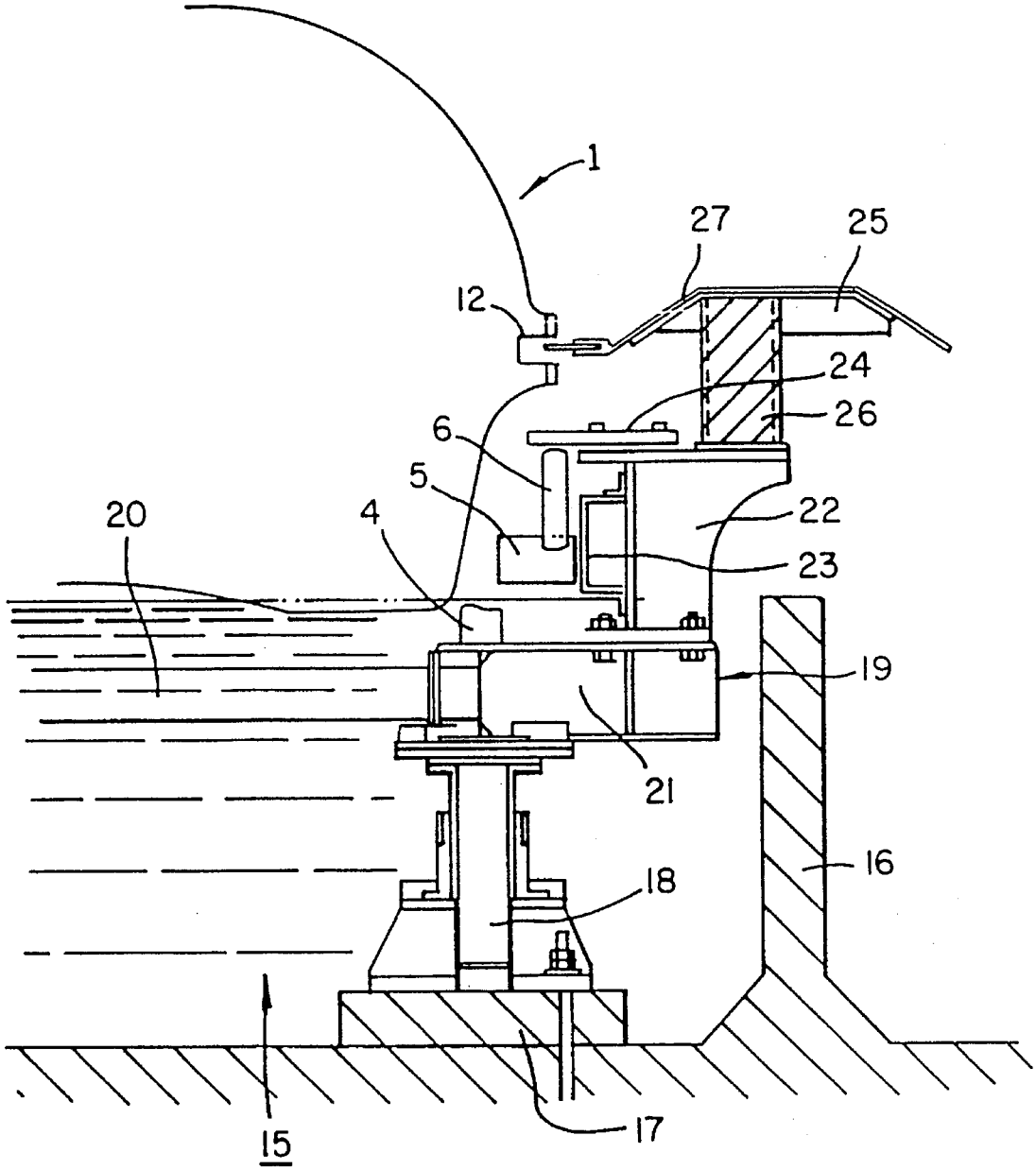
FIG. 6 is an illustrative sectional view showing an essential portion where the amusement vehicle travels on the water channel.
Figure 7:
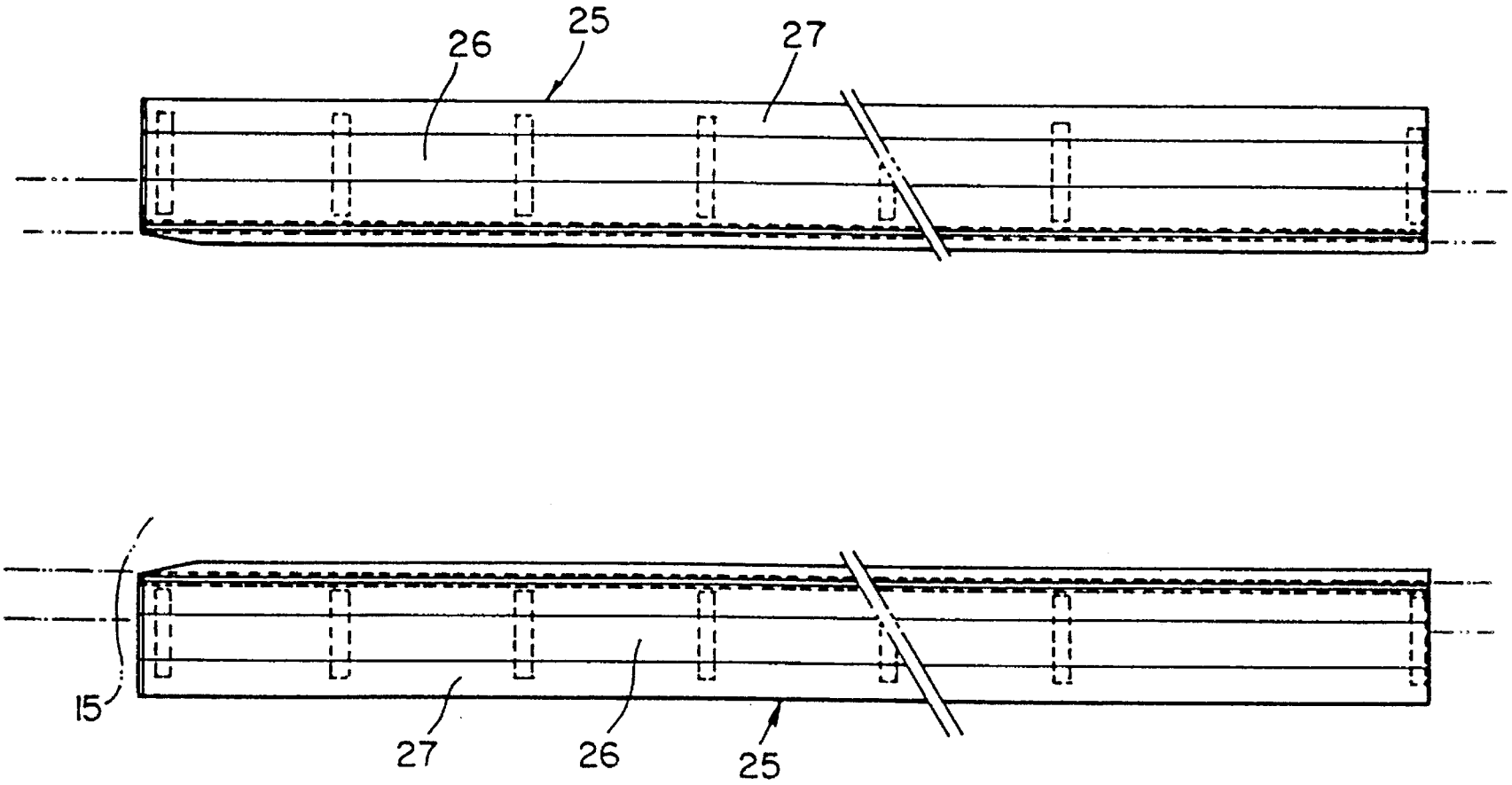
FIG. 7 is a plan view showing the water channel on which the amusement vehicle travels.
Figure 9:
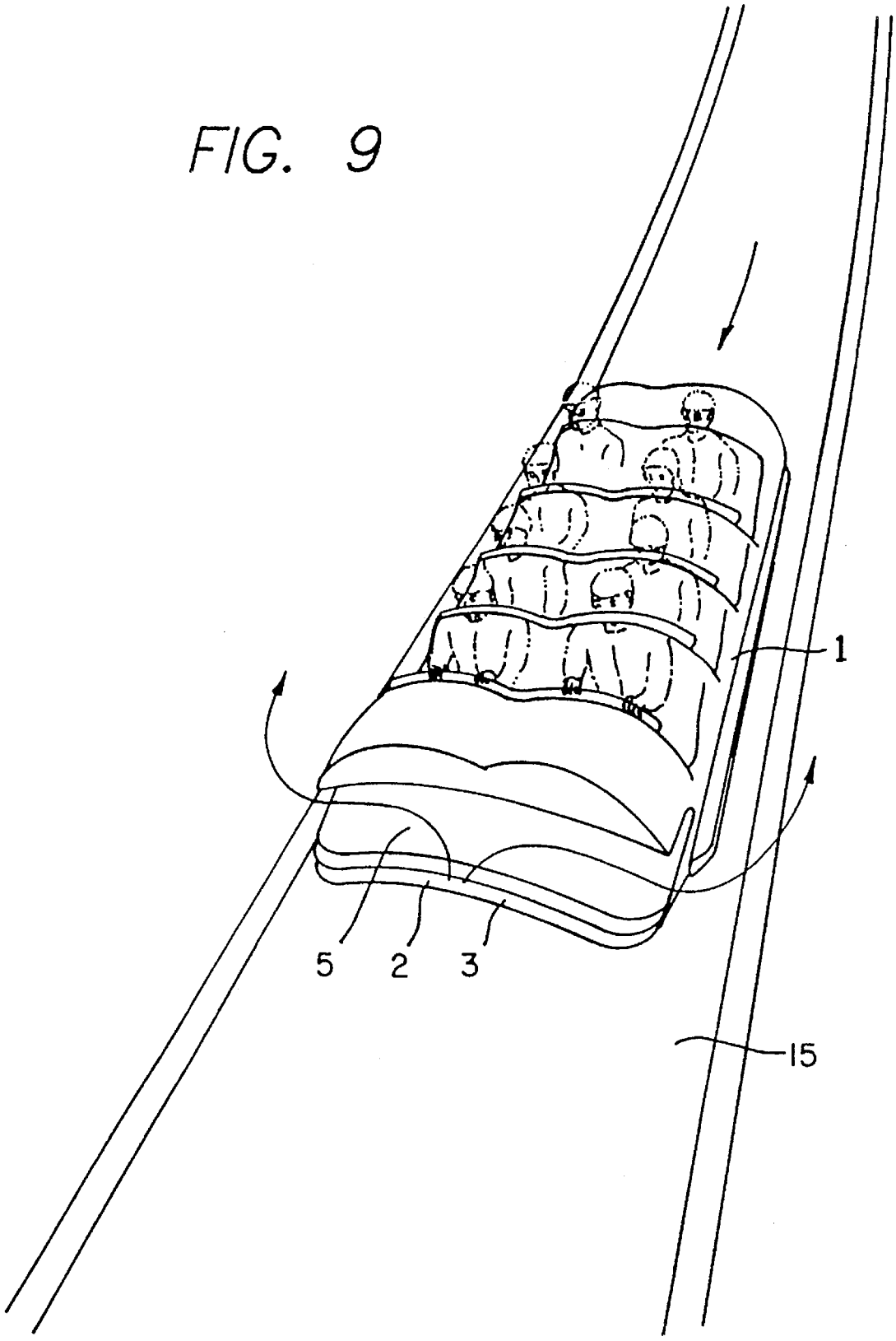
FIG. 9 is an illustration showing a scene where the amusement vehicle of the present invention travels on the water channel.

The passage on which the amusement vehicle 1 travels down is described below. FIG. 6 shows a state where the amusement vehicle 1 travels on a water channel 15 with a predetermined water level.

As for the water channel 15, a pair of bases 17 are provided in the longitudinal direction of the water channel formed between channel walls 16 constituting the passage, and a pair of rail assemblies 19 are installed on posts 18 erected on the bases 17. The rail assemblies 19 are connected by beams 20.

Each of the rail assemblies 19 consist of a traveling rail 21 with a face to allow the rolling of the main wheels 4 of the amusement vehicle 1 and a side guard 22 vertically erected on the traveling rail 21. The side guard 22 is provided with a guide rail 23 to be in contact with the guide wheels 5.

Each of the rail assemblies 19 composed as above is provided with a floating preventive member 24 to be engaged with the support wheels 6 for preventing the floating of the amusement vehicle 1.

Each of the rail assemblies 19 is provided with a splashing preventive means 25. The splashing preventive means 25 has a guard plate 27 trapezoidal in cross section extending toward the water channel and also away from the water channel, on a post 26 on the side guard 22. The guard plate 27 is covered, at its edge on the water channel side, with an elastic member (rubber), to enter the corresponding guide groove 12 of the amusement vehicle 1.

The amusement vehicle of the present invention is composed as described above. The action of the amusement vehicle 1 traveling on the water channel 15 is described below.

If the amusement vehicle 1 is allowed to travel down by its dead weight from the gradient passage, it plunges into the water channel 15 at a predetermined dip. The amusement vehicle 1 travels with its main wheels 4 rolling on the traveling rails 21 of the rail assemblies 19. Furthermore, the guide wheels 5 are kept in contact with the guide rails 23 of the side guards 22, and the floating preventing members 24 are kept engaged with the support wheels 6 for prevention of floating. So, the amusement vehicle 1 can travel stably without floating.

Moreover, in this case, since the guide grooves 12 of the amusement vehicle 1 are slidably engaged with the guard plates 27 of the splashing preventive means 25, the stable traveling of the amusement vehicle 1 is further ensured.

The water in the water channel 15 collides with the cut-out portion 10 at the tip 2 of the vehicular main body and with the bottom 3 below the tip 2 of the vehicular main body, and is pushed away sideways from the cut-out portion 10 along the water guide faces 11. Some water goes along the under face of the tip 2 of the vehicular main body to reach the bottom 3, passing through the space 13 near the central axis in the longitudinal direction of the vehicular main body toward the stern. Additional water goes around the flanks 14 of the boat from the under face of the tip 2 of the vehicular main body, being pushed away outward in the width direction of the vehicular main body according to the form of the flanks 14 (see FIG. 10).

Since the water colliding with the vehicular main body is guided along the vehicular main body rearward and sideways, the alighting impact can be eased, and the quantity of water pushed forward is decreased, to lessen splashes.

Even if the water going around the flanks of the vehicular main body tends to splash, the guard plates 27 of the splashing preventive means 25 prevents the splashes, to protect the passengers from being directly splashed.

Further, when the amusement vehicle travels on the water channel 15 after completion of alighting, water travels along the under face of the tip 2 of the vehicular main body to reach the bottom 3, then passing through the space near the central axis in the longitudinal direction of the vehicular main body rearward, and also travels along the flanks 14 of the boat from the under face of the tip 2 of the vehicular main body, being pushed away outward in the width direction of the vehicular main body according to the form of the flanks 14. In this manner, splashing is prevented.

In this case, the amusement vehicle 1 is braked by the large resistance of water and can stop after a proper traveling distance.

The above description of action refers to a case where the amusement vehicle travels on the water channel 15. The amusement vehicle 1 is not necessarily required to have the wheels. The floating preventive members 24 and the splashing preventive means 25 can be in any other proper combination, and even if they are not provided at all, the amusement vehicle 1 can effectively prevent splashing by the forms of its bottom and flanks. In this case, the structure of the water channel should be correspondingly modified.

As described above, since the present invention does not require the descending height of the amusement vehicle to be kept low, the attractiveness as an amusement apparatus is not impaired, and the direct splashing on passengers can be prevented without using PVC covers, etc. for protection from splashes.

We claim:

1. An amusement ride of the type in which passengers are transported down a vertically inclined chute having side walls, to pass through a region of the chute containing water, intended to prevent splashing of the passengers, the amusement ride comprising:

rail assemblies extending along said chute; and a vehicle shaped to fit within the chute in spatial relation to the side walls and the rail assemblies to travel along the chute in a forward direction while maintaining such spacing, said vehicle comprising:

means for contacting the rail assemblies to guide said vehicle for motion in a forward direction longitudinally along the chute without flotation as it passes through the water filled region;

a watertight upwardly open interior region for accommodating the passengers;

a forward end and a rearward end;

a bottom configured to define a centered concave channel extending longitudinally substantially between said forward end and said rearward end of said vehicle, for accommodating the passage of water; and side surfaces extending longitudinally rearwardly of said vehicle in spaced relation from and facing toward the side walls of the chute, said side surfaces being curved upwardly and outwardly away from said interior region to deflect water displaced by the passing of the vehicle through the water away from the interior region to avoid splashing the passengers.

2. An amusement ride according to claim 1, wherein said rail assemblies of said chute are each configured to provide a substantially vertical surface, and said vehicle further comprises:

a plurality of main wheels rotatably attached to the vehicle positioned to allow the vehicle to roll upon said main wheels when moved upon a solid surface;

a plurality of guide wheels rotatably attached to the vehicle positioned to cause rolling of said guide wheels when the vehicle is moved in generally horizontal motion and said guide wheels contact said substantially vertical surface.

3. An amusement ride according to claim 1, wherein said vehicle further comprises a plurality of anti-float wheels.

4. An amusement ride according to claim 3, wherein the rail assemblies comprise floating preventive means adapted to engage said anti-float wheels to prevent the floating of the vehicle while the vehicle is travelling down the passage.

5. An amusement ride according to claim 1, wherein the vehicle is provided, on its flanks, with guide grooves, and each of said rail assemblies is provided, at its upper portions, with splashing preventive means to be idly engaged with said guide grooves.

6. An amusement ride comprising:

a vehicle comprising a bottom and a plurality of flanks extending upwardly from said bottom, wherein the upper portions of said flanks protrude outside in the width direction of the vehicle main body, said bottom defining a concave channel extending longitudinally along a central axis of said vehicle, said flanks being curved surfaces defining concave channels extending substantially longitudinally along said vehicle, said vehicle further comprising guide grooves; and a water channel through which the vehicle may travel, said water channel having a gradient passage being provided with splashing preventive means at its upper portions, said splashing preventive means configured to be idly engaged with said guide grooves.

7. An amusement ride of the type in which passengers are transported down a water incline, with diminished water splashing of the passengers, the amusement ride comprising:

rail assemblies extending along said incline, a vehicle configured for contact with said rail assemblies, said vehicle having a forward end, a rearward end, and an open interior region situated therebetween for accommodating the passengers, the forward end being configured to provide an upwardly-facing cutout portion spreading outwardly from the forward end toward the rearward end for diminishing splashing of the passengers.

8. An amusement ride of claim 7, wherein said cutout portion of said vehicle has guide faces formed symmetrically about a central axis of said vehicle.

9. An amusement ride according to claim 7, wherein said vehicle has a bottom configured to provide a centered concave longitudinal channel extending substantially the length of the vehicle between said forward end and said rearward end.

10. An amusement ride according to claim 7, wherein said vehicle comprises side surfaces extending longitudinally rearwardly of said vehicle, said side surfaces being configured to curve upwardly and outwardly away from said interior region to deflect water displaced by the passage of the vehicle through the water.

11. An amusement ride according to claim 7, wherein said rail assemblies are each configured to provide a substantially vertical surface and said vehicle comprises:

a plurality of vertically-oriented wheels rotatably supporting said vehicle on said rail assemblies;

a plurality of horizontally-oriented wheels rotatably guiding said vehicle along said vertical surface of said rail assemblies.

12. An amusement ride according to claim 7, wherein said vehicle comprises a plurality of anti-float wheels.

13. An amusement ride according to claim 12, wherein said rail assemblies comprise floating preventive members configured for contact with said anti-float wheels.

14. An amusement ride according to claim 7, wherein said vehicle comprises lateral guide grooves, and said rail assemblies comprise splashing preventive members configured to idly engage said guide grooves.

15. An amusement ride according to claim 14, wherein said splashing preventive members comprise an elastic end member idly engaging said guide grooves.

16. An amusement ride according to claim 14, wherein said splashing preventive members comprise guard plates extending laterally from said rail assemblies.

* * * * *